United States Patent [19]

Tarumi et al.

[11] 4,434,218

[45] Feb. 28, 1984

[54] PHOTOSENSITIVE COMPOSITION FOR ELECTROPHOTOGRAPHY

[75] Inventors: Noriyoshi Tarumi; Akihiko Tamura; Masakazu Kokiso, all of Tokyo, Japan

[73] Assignee: Konishiroku Photo Industry Co., Ltd., Tokyo, Japan

[21] Appl. No.: 270,115

[22] Filed: Jun. 3, 1981

Related U.S. Application Data

[63] Continuation of Ser. No. 6,104, Jan. 24, 1979, abandoned, which is a continuation of Ser. No. 746,084, Nov. 30, 1976, abandoned.

[51] Int. Cl.[3] ..... G03G 5/04

[52] U.S. Cl. ..... 430/96; 430/130

[58] Field of Search ..... 430/127, 96, 130

[56] References Cited

U.S. PATENT DOCUMENTS 2,993,787 7/1961 Sugarman, Jr. .
2,997,387 8/1961 Tanenbaum .
3,065,160 11/1962 Levinos .
3,732,096 8/1973 Honjo et al. .
4,252,883 2/1981 Komura et al. ..... 430/127

FOREIGN PATENT DOCUMENTS 204093 of 0000 Australia .
560435 7/1958 Canada ..... 430/96
1188330 of 0000 United Kingdom .
893491 of 1962 United Kingdom .

*Primary Examiner*—John E. Kittle
*Assistant Examiner*—John L. Goodrow
*Attorney, Agent, or Firm*—Lane, Aitken & Kananen

[57] ABSTRACT

A novel photosensitive composition including a photoconductive cadmium sulfide-group compound and a water-soluble prepolymer capable of forming a network structure by cross-linking, the composition being applied as a photosensitive layer of a photosensitive article for electrophotography having a conductive substrate.

15 Claims, No Drawings

PHOTOSENSITIVE COMPOSITION FOR ELECTROPHOTOGRAPHY

This application is a continuation, of application Ser. No. 6,104, filed Jan. 24, 1979 which is a continuation of Ser. No. 746,084, filed Nov. 30, 1976 both now abandoned.

BACKGROUND OF THE INVENTION

This invention relates to an electrophotographic photosensitive composition of a binder type which includes as a binder resin a water-soluble prepolymer capable of forming a network structure by cross-linking and as a photoconductive material a cadmium sulfide or similar inorganic compound (hereinlater referred to as "cadmium sulfide-group compound", which term is intended to mean semi-conductive compounds such as a sulfide and/or selenide of zinc or cadmium).

Photosensitive articles for electrophotography can be broadly classified into two categories: a metal plate vacuum-deposited with amorphous selenium; and a photosensitive article having a photosensitive layer obtained by coating one surface of a conductive substrate with a photosensitive composition obtained by dispersing a photoconductive inorganic compound in a solution of a binder resin in an organic solvent. The present invention more specifically relates to an electrophotographic photosensitive composition (hereinafter referred to briefly as photosensitive composition) suitable for the fabrication of the latter binder type photosensitive article for electrophotography.

Known photosensitive compositions are generally prepared by dispersing photoconductive inorganic compounds in solutions which are obtained by dissolving homopolymers or interpolymers of monomers such as ethylene, styrene, methacrylic acid esters, acrylic acid esters, vinyl acetate, vinyl chloride, vinylidene chloride, butadiene, etc., silicon resin, epoxy resin, or alkyd resin, in organic solvents such as acetone, benzene, toluene, ethyl acetate, trichloroethylene and the like. A cadmium sulfide-group compound which is one of the photoconductive inorganic compounds has inherently a greater affinity for water than for organic solvents and is thus hard to disperse in solutions of resins in organic solvents. This makes it very difficult to obtain a uniform dispersion by dispersing the cadmium sulfide-group compound in the binder solutions in organic solvents even if a great deal of expense and labor is employed. That is, in known photosensitive compositions using organic solvents to prepare resin solutions, the resins dissolved in organic solvents are generally poor in affinity for and adsorptivity on the powder of a photoconductive cadmium sulfide-group compound, so that not only the powder of the photoconductive cadmium sulfide-group compound can not be covered satisfactorily with the resin, but also organic solvent remaining between the powder of the photoconductive cadmium sulfide-group compound and the resin is evaporated when the photosensitive composition is applied onto a conductive substrate and dried, leaving voids in the resulting photosensitive layer. These voids increase hygroscopicity of the photosensitive layer, lowering the electrophotographic properties of the layer.

On the other hand, in order to improve the dispersiveness of photoconductive inorganic compounds and avoid ill effects of organic solvents the use of which is generally unfavorable from a viewpoint of environmental pollution or public nuisance, there are known photosensitive compositions which are prepared by dispersing photoconductive inorganic compounds in aqueous resin dispersions or resin latices. However, these aqueous photosensitive compositions are disadvantageous in that the photosensitive layer derived from such aqueous composition tends to inevitably contain moisture therein and even a trace of the moisture in the photosensitive layer adversely affects the electrophotographic properties of the layer to a considerable extent. For instance, photosensitive compositions obtained by dispersing powder of photoconductive cadmium sulfide-group compounds in aqueous latices fail to produce a photosensitive layer which is excellent in moisture proofness since voids are likely to be formed in the photosensitive layer obtained from such composition when the composition is applied onto a conductive substrate and dried to form a film from the latex. Accordingly, aqueous photosensitive compositions are not yet of practical use.

SUMMARY OF THE INVENTION

In accordance with the present invention, there is provided a novel photosensitive composition including a photoconductive cadmium sulfide-group compound and a water-soluble prepolymer (hereinafter referred to merely as prepolymer) capable of forming a network structure by cross-linking.

The photosensitive composition according to the invention can be prepared by dispersing a photoconductive cadmium sulfide-group compound in an aqueous solution of the prepolymer with or without adding thereto an alcohol additive in an amount sufficient to improve the solubility of the prepolymer in water. The present invention has an advantage that there is used no organic solvent. Use of an organic solvent is undesirable for operational and sanitary reasons. The photosensitive composition prepared by dispersing powder of a photoconductive cadmium sulfide-group compound in an aqueous solution of a prepolymer is characterized by a uniform dispersion of the powder in the aqueous solution, i.e., excellent dispersiveness, and easiness in coating application, and can readily yield a photosensitive layer with a uniform and smooth surface. Upon thermally curing, the prepolymer of the photosensitive layer is cross-linked to form a strong network structure therein. Accordingly, a photosensitive article having the photosensitive layer formed from the photosensitive composition of the invention is excellent in electrical and mechanical durabilities, particularly corona discharge characteristics.

The prepolymer used in the photosensitive composition of the invention has a great affinity for the powder of a photoconductive cadmium sulfide-group compound and can readily cover the powder therewith when the powder is dispersed in the prepolymer solution. In addition, when cross-linked, the prepolymer can form a waterproof film, thus rendering a photosensitive layer moisture proof.

The photosensitive article having the layer formed from the photosensitive composition of the invention is high in image density when an image is formed on the photosensitive layer, and produces little or no fog on the basis of residual electric charge, with excellent characteristics such as high photosensitivity. Presumably, this is attributable to the characteristic properties and dispersiveness of the prepolymer used. The present invention has an advantage that since the photosensitive composition of the invention is an aqueous system, photosensitive layers can be formed directly on an endless drum mounted in duplicators by an electro coating process, making it easy to mass produce.

It has been heretofore considered impossible to use an aqueous system or material as a binder for the photosensitive layer of an electrophotographic photosensitive article since such aqueous system gives an adverse influence on electrical properties of the photosensitive article. Accordingly, to form an excellent photosensitive layer from an aqueous composition comprising a photoconductive cadmium sulfide-group compound and a water-soluble prepolymer binder capable of forming a network structure by cross-linking is considered to be an epochmaking, novel technique as ever known in the art.

It is therefore an object of the present invention to provide a photosensitive composition which has excellent dispersiveness and is easy to coat and which is free of organic solvents which are unfavorable to use from a viewpoint of environmental pollution.

It is another object of the present invention to provide a photosensitive composition which can yield an electrographic photosensitive article excellent in moisture proof and electrophotographic properties.

DETAILED DESCRIPTION OF THE INVENTION

The photoconductive cadmium sulfide-group compounds useful in the present invention include, for example, cadmium sulfide, cadmium selenide, cadmium sulfoselenide, zinc sulfide, zinc selenide and the like.

The prepolymers suitable for the practice of the invention may be of a self-hardening type which can cross-link to form a network structure by the action of light or heat, or may be of a type which is required to be added with a hardener or a polymerization accelerator and cross-links at a normal temperature or, if required, at an elevated temperature to form a network structure. Both types of the prepolymers are useful in the present invention. The prepolymers used are relatively low molecular weight compounds and are polymers or copolymers having a number of hydroxyl groups or carboxyl groups therein, or the carboxyl groups of which are combined with ammonia. With the latter case, the polymers may preferably have a molecular weight below 50,000, especially below 10,000, so as to ensure excellent dispersiveness and an easy-to-coat property.

In case that there is used a prepolymer having carboxyl groups or hydroxyl groups, it is preferred that the prepolymer has an acid value of not lower than 20 so as to have a desired solubility in water. (The term "acid value" is defined as the number of milligrams of potassium hydroxide required to neutralize one gram of the prepolymer.) Whereas in case there is used a prepolymer having amino groups or substituted amino groups such as methylol amino group, it is preferred the prepolymer has an amine value of not lower than 15. (The term amine value is defined as the number of milligrams of hydrogen chloride required to neutralize one gram of the amino group-containing prepolymer.)

The former-type water-soluble prepolymers include, for example, alkyd resin prepolymers, phenolic resin prepolymers epoxy resin prepolymers, polyacrylic acid prepolymers, polyvinylether prepolymers, polyvinylalcohol prepolymers and a mixture or copolymer thereof. The latter-type water-soluble prepolymers include, for example, amino resin prepolymers, urethane resin prepolymers, polyacrylamide prepolymers, polyvinylpyrrolidone prepolymers and a copolymer or mixture thereof.

In addition, in case that the water soluble prepolymer is in the form of a copolymer or a mixture of the former and the latter, it is preferred that the sum of the acid and amine values of the prepolymer be not lower than 15.

Apart from the above, the prepolymers usable in the present invention are broadly classified into two groups, i.e., condensation-type prepolymers and polymerization-type prepolymers. The condensation-type prepolymers will be first described.

The condensation-type prepolymers are, for example, prepolymers of alkyd resins, phenolic resins, amino resins, epoxy resins, urethane resins and the like. In the practice of the invention, these prepolymers contain a number of carboxyl groups or hydroxyl groups in structural units and part of the carboxyl groups may be, if desired, combined with ammonium group, to have the above mentioned range of acid- or amine-values and thereby render the prepolymers hydrophilic. Preferably, prepolymers of alkyd resins, epoxy resins, phenolic resins and melamine resins to be one of amino resins are used.

Examples of the alkyd resin prepolymers containing bifunctional acids as the constituent are those obtained by subjecting phthalic acid and pentaerythritol to a dehydration condensation reaction and combining the carboxyl groups with ammonium groups, and having recurring units presumably expressed by the following formula

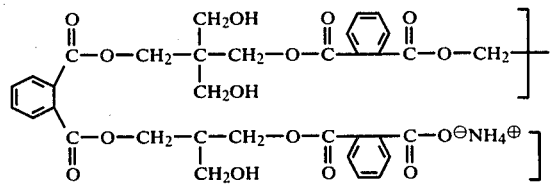

Examples of the alkyd resin prepolymers having trifunctional acids as the constituent are those obtained by combining trimellitic acid anhydride, glycols, and adipic acid, with the structural units expressed by the following formula

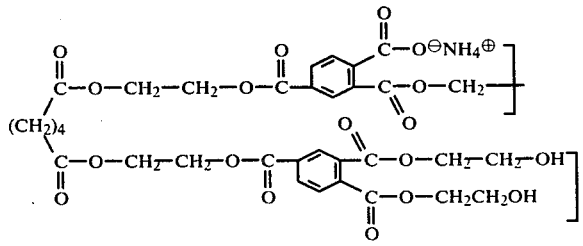

Water-soluble alkyd resin prepolymers utilizing polyoxyethylene bonds are usable in the present invention and one example of the prepolymer is that obtained by combining, for example, phthalic acid anhydride, pentaerythritol, polyethylene glycol and an aliphatic acid, with structural units presumably expressed by the following formula

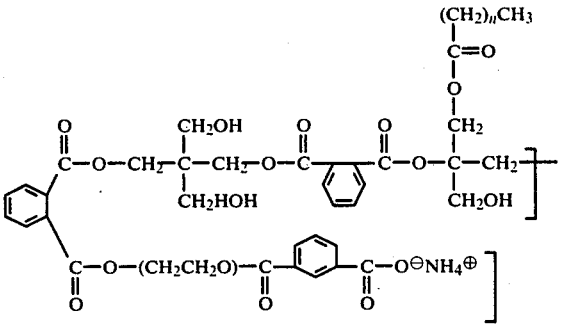

These prepolymers have been already put on the market, under the designations (1) Water Sol S-123 (available from Dainihon Ink K.K.), (2) Water Sol S-126 (available from Dainihon Ink K.K.), (3) Water Sol S-140 (available from Dainihon Ink K.K.) and (4) Water Sol S-100D (available from Dainihon Ink K.K.) which are preferably usable in the present invention.

Water-soluble prepolymers of the condensation-type epoxy resins useful in the present invention are those obtained by reacting a reaction product of equi-chlorohydrin and diphenylolpropane expressed by a formula

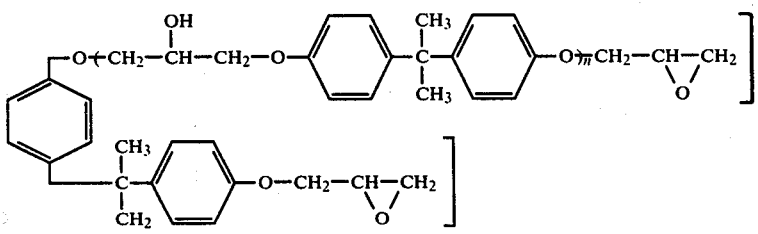

with, for example, $H_3PO_4$, $H_2SO_4$,

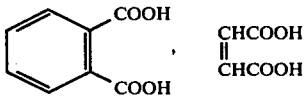

or the like acids to correspondingly convert by esterification the end group of the reaction product

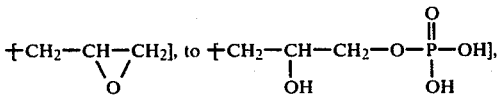

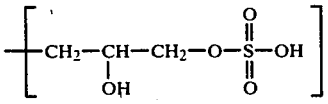

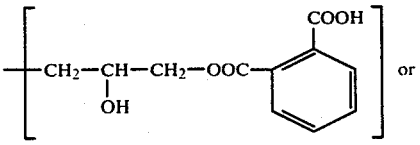

or

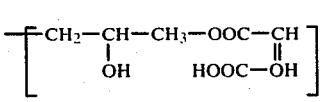

and further treating with an alkali metal atom or preferably ammonia to form a salt for rendering the prepolymers water-soluble. These prepolymers have been also placed on the market and preferable ones are (5) Water Sol S-168 (available from Dainihon Ink K.K.) and (6) Kis Sol HF (available from Osak Varnish K.K.).

Water-soluble prepolymers of the condensation-type melamine resins are mono- to hexamethylolmelamines obtained by reacting melamine and formaldehyde, including, for example, trimethylomelamine of the following formula and derivatives thereof

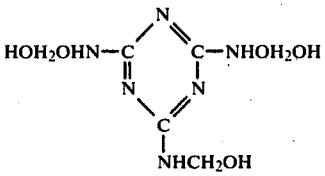

and mono- to hexamethoxymethylmelamines obtained by reacting methylolmelamine and methanol, including, for example hexamethoxymethylmelamine of the following formula and derivatives thereof

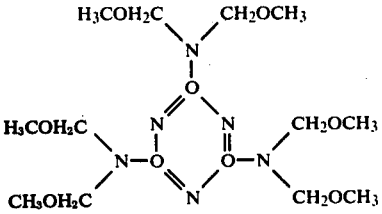

other prepolymers of the condensation-type melamine resins are those obtained by subjecting a primary condensate of methylolmelamine to a condensation with a polyatomic amine such as an alkylene polyatomic amine, a hydroxy polyatomic amine or guanidine. Though these melamine resin prepolymers can be used by themselves, they are suitable for use as a hardener for the prepolymers of the aforementioned alkyd resins, and epoxy resins, and of acrylic resins to be a polymerization-type water-soluble resin which will be described hereinafter. These melamine resin prepolymers are commercially available under the designations (7) Water Sol S-695 (available from Dainihon Ink K.K.)
(8) Water Sol S-616 (available from Dainihon Ink K.K.)
(9) Nikalac Mw-12 (available from Sanwa Chemicals K.K.)

(10) Nikalac Mw-22 (available from Sanwa Chemicals K.K.)
(11) Nikalac Mw-30 (available from Sanwa Chemicals K.K.)
(12) Nikalac Mx-40 (available from Sanwa Chemicals K.K.)

These prepolymers may be used singly or in combination.

Water-soluble prepolymers of condensation-type phenolic resins are phenol alcohols obtained by reacting phenols and formaldehyde, including 3,5,3',5'-tetramethylol-4,4'-dihydroxydiphenylmethane having the following formula

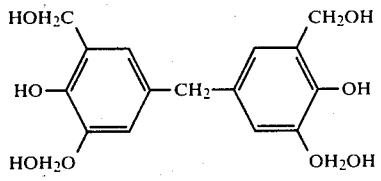

Further, high molecular weight prepolymers can be obtained by introducing into a polynuclear phenolic resin such as novolac resin, carboxyl groups and then methylol groups, and treating with ammonia to form a resin salt. Though these prepolymers may be used as a prepolymer binder of the invention, they are preferable to be used as a hardener for the water-soluble prepolymers of the aforementioned alkyd resins or polymerization-type water-soluble resins which will be described hereinafter.

Further water-soluble prepolymers of condensation-type resins and preferably usable in the practice of the invention include hydroxyalkyl celluloses obtained by treating alkali celluloses with alkylene oxides and alkyl celluloses obtained by treating alkali celluloses with alkyl halides. These water-soluble cellulose derivatives can be readily formed into a network structure by treating them with a cross-linking agent such as glyoxal, urea resin prepolymers, melamine resin prepolymers or polybasic acids.

Preferable water-soluble prepolymers of the polymerization-type resins include, for example, those of polyacrylic acid and derivatives thereof, polyacrylamide, polyvinyl pyrrolidone, polyvinyl ether and polyvinyl alcohol.

The polyacrylic acid and derivatives thereof are homopolymers of acrylic acid or methacrylic acid, copolymers of acrylic acid alkyl esters or methacrylic acid alkyl esters carboxyl groups of which are combined with ammonia. Apart from prepolymers derived from monomers of acrylic acid, methacrylic acid and esters thereof, interpolymers of monomers such as maleic acid anhydride, itaconic acid, methacrylamide, acrylamide, ammonium acrylate, ammonium methacrylate, methyl vinyl ether and the like.

Examples of prepolymers of the polyacrylamide resins are those of acrylamide homopolymer and copolymers of acrylamide and a monomer such as acrolein, acrylic acid esters, acrylic acid, methacrylic acid, acrylonitrile, butadiene, methacrylic acid esters, diallylcyanamide, glycidyl acrylate, maleic anhydride, methacrylamide, styrene, unsaturated aliphatic acid-modified alkyd resin monomers, vinyl acetate, vinyl chloride, vinyl ether vinyl ketone, vinylpyridine, or vinylpyrrolidone. In addition, there may be also used prepolymers of acrylamide-base interpolymers having, as structural units, oxymethylated acrylamide or oxymethylated copolymer units of acrylamide and N-vinyllactam.

The water-soluble prepolymers of the aforementioned acrylic acid and derivatives thereof, and of acrylamide-base resins are commercially available under the designations

(13) Water Sol S-727 (available from Dainihon Ink K.K.)
(14) Water Sol S-767 (available from Dainihon Ink K.K.)
(15) Water Sol S-754 (available from Dainihon Ink K.K.)

Futher, prepolymers of polyvinyl alcohol, polyvinylpyrrolidone and polyvinyl ether may be used singly or in combination with acrylic acid, methacrylic acid or esters thereof, and acrylamide in the form of copolymers. As a matter of course, the prepolymers mentioned hereinbefore may be used singly or in mixture with two or more. Aside from the aforementioned prepolymers, natural and synthetic compounds having a number of hydroxyl groups or carboxyl groups, other water-soluble compounds and compounds which are rendered water-soluble by formation of salts or copolymerization may be also used in the practice of the invention, e.g., the compounds which are hardenable upon polymerization or condensation by the action of polymerization accelerators such as cobalt naphthenate, calcium naphthenate and lead naphthenate, or hardeners such as aldehydes, maleamine resin prepolymers, phenolic resin prepolymers and epoxy ester resin prepolymers.

In the preparation of the photosensitive composition of the invention, a photoconductive cadmium sulfide-group compound is first reduced to powder having an average particle size preferably below 2$\mu$ in accordance with a method as described in detail in U.S. Pat. No. 3,743,609 and Japanese Patent Publication Nos. 4768/1957 and 20754/1972. Then, the photosensitive composition can be prepared by mixing 100 parts by weight of the photoconductive powder, 10–100 parts by weight, preferably 20–80 parts by weight, of a prepolymer as solid component, if required, 0–100 parts by weight of a water- or alcohol-soluble hardener or 0–10 parts by weight of a polymerization accelerator, 20–300 parts by weight, preferably 80–200 parts by weight, of water, if required, 0–300 parts by weight of an alcohol-base amphipathic solvent for improving the solubility of the prepolymer in water, and also if required, an amino-base neutralizing agent to render the prepolymer soluble in water and a surface active agent to improve the wetting property of the composition, and dispersing the resulting mixture by means of a homogenizer, a ball mill, a sand mill, an ultrasonic dispersing device or the like.

The hardeners or polymerization accelerators used in the preparation of the photosensitive composition of the invention include, for example, cobalt naphthenate, calcium naphthenate, and lead naphthenate as polymerization accelerator, and aldehydes such as glyoxal, urea resin prepolymers, polybasic acids, prepolymers of melamine resins, phenolic resin prepolymer epoxy ester resin prepolymers and the like as hardener. These hardeners and polymerization accelerators may be used in proper amount in consideration of the kind of the prepolymer, the hardening reaction time and temperature, the kind of the photoconductive inorganic compound, the characteristic properties and surface hardness of the electrophotographic photosensitive layer to be formed, and the like factors.

The amphipathic solvents useful in the present invention are, for example, methyl alcohol, ethyl alcohol, isopropyl alcohol, n-propyl alcohol, secondary or tertiary butyl alcohol, methyl cellosolve, butyl cellosolve, ethoxybutyl alcohol, and ethers. The amount of the amphipatic solvent may be properly selected within the above-defined range depending on the kind of the prepolymer, the concentration of the prepolymer in an aqueous solution. The neutralizing agent suitable for the photosensitive composition of the invention are basic compounds which can neutralize acid groups such as carboxyl group of the prepolymers to render the neutralized prepolymer soluble in water. Upon heating and drying, the basic compounds must be vaporized and set free, thereby producing free carboxyl groups and rendering the prepolymer hydrophobic. Examples of such basic compounds include, for example, ammonia, trimethylamine, mono-, di-, triethanol amine, dimethylaminoethanol, diethylaminoethanol and the like. The amount may be varied within the above-defined range depending on the kind and concentration of the prepolymer.

Preferable surface active agents useful in the present invention are fluorine-containing surface active agents and are commercially available under the designations, Megafax F-121, F-141, F-150 (products of Dainihon Ink K.K.) and FC-430 (product of Sumitomo 3M Co.) The photosensitive composition of the invention is applied in a dry thickness of about 5–40μ onto a conductive support such as a conductive paper sheet, a metal plate, a thin metal film-laminated plastic film or the like. If desired, the conductive support may be formed on one surface thereof with an undercoat layer such as of a polymeric quaternary amine salt, casein, polyvinyl alcohol, carboxymethyl cellulose, hydroxy cellulose, alkyl cellulose, water-soluble nylon, polyvinyl acetate or the like. The applied photosensitive composition layer is then thermally cured at a temperature in the range of a normal temperature to 300° C., preferably 60° to 250° C., for a time period of 15 minutes to 3 hours, thereby forming an hydrophobic, strong photosensitive layer for electrophotography.

In the practice of the invention, a single photosensitive layer may be formed on a support, or a plurality of photosensitive layers with different electrophotographic properties or physical properties may be superposed, e.g., a combination of a photosensitive layer with excellent chargeability as lower layer and a photosensitive layer with high sensitivity and excellent mechanical abrasion resistance as an upper layer, or a combination of a photosensitive layer formed from a known solvent-type photosensitive composition as lower layer and a photosensitive layer formed from the photosensitive composition of the invention as upper layer will have practical utility.

The present invention will be particularly described by way of the following examples, which should not be construed as limiting thereto the present invention.

EXAMPLE 1

| Formulation Of Photosensitive Composition A | |
|---|---|
| high sensitive cadmium sulfide powder with an average particle size of 1μ | 10 g |
| exemplified prepolymer (2) (water-soluble alkyd resin prepolymer having a solid content of 50%) | 6 g |
| exemplified prepolymer (7) (water-soluble melamine resin prepolymer having a solid content of 66%) | 1.5 g |
| water | 4 ml |
| methyl alcohol | 2 ml |
| isopropyl alcohol | 2 ml |
| **Formulation Of Photosensitive Composition B** | |
| high sensitive cadmium sulfide powder having an average particle size of 2μ | 10 g |
| exemplified prepolymer (13) (baking type acrylic resin prepolymer having a solid content of 60%) | 5 g |
| exemplified prepolymer (7) | 2 g |
| water | 6 ml |
| methyl cellosolve | 2 ml |
| FC-430 (fluorine-containing surface active agent) | 0.08 g |
| **Formulation Of Photosensitive Composition C** | |
| high sensitive cadmium sulfide fine crystals having an average particle size of 2μ | 10 g |
| exemplified prepolymer (3) (water-soluble alkyd resin prepolymer having a solid content of 70%) | 4.3 g |
| water | 4 ml |
| ethyl alcohol | 4 ml |
| **Formulation Of Photosensitive Composition D** | |
| high sensitive cadmium sulfide fine crystals having an average particle size of 2μ | 10 g |
| exemplified prepolymer (4) (water-soluble alkyd resin prepolymer having a solid content of 60%) | 6 g |
| aqueous 5% calcium naphthenate solution | 0.08 g |
| aqueous 20% lead naphthenate | 0.05 g |

Four kinds of the above photosensitive compositions were each mixed sufficiently by means of an ultrasonic dispersing device and applied onto a 100μ thick stainless plate by a coating method using a wire bar such that the film thickness obtained after drying was 30μ. Then, the films obtained from the compositions (A)–(C) were each thermally treated at 150° C. for 30 minutes and the film of the composition (D) was thermally cured at 80° C. for 1 hour, thereby obtaining four kinds of photosensitive films (sample Nos. 1–4).

EXAMPLE 2

| Formulation Of Photosensitive Composition E | |
|---|---|
| high sensitive cadmium sulfide fine crystals having an average particle size of 1μ | 10 g |
| exemplified prepolymer (2) | 6.4 g |
| exemplified prepolymer (5) (epoxy ester prepolymer having a solid content of 76%) | 0.5 g |
| exemplified prepolymer (7) | 0.6 g |
| water | 7 ml |
| ethyl alcohol | 2 ml |
| aqueous 30% ammonia | 1 ml |
| FC-430 | 0.15 g |

The above mixture was sufficiently dispersed by means of an ultrasonic dispersing device to prepare a photosensitive composition. The thus prepared photosensitve composition was applied onto a 175μ thick polyester film to be a temporary support from which the resulting film was removed at a final step, by a wire bar coating technique in such a manner that the film thickness obtained after drying was 20μ. The applied composition was thermally treated at 140° C. for 20 minutes, onto which the same composition as used above except that no surface active agent was employed was further applied and dried so that the dry film thickness was 30μ, followed by a thermal treatment at 140° C. for 1 hour to obtain superposed photosensitive layers.

Onto the superposed photosensitive layers was further applied a quaternary amine cation conductive agent pq-T14 (product of Soken Chemicals K.K.) by a wire bar coating technique so that the film thickness after drying was 5μ, followed by drying to form an intermediate undercoat layer. Then, a dispersion obtained by dispersing a conductive agent having the following formulation in a ball mill was coated onto the intermediate undercoat layer by a wire bar coating technique, dried and thermally treated at 130° C. for 1 hour to form an intermediate conductive layer.

| Formulation Of Conductive Agent | |
|---|---|
| conductive carbon HS-500 (product of Asahi Carbon K.K.) | 7 g |
| thermosetting alkyd resin J-555 (product of Dainihon Ink K.K.) | 40 g |
| butyl acetate | 150 ml |

Then, a 100μ thick stainless steel plate to be a true support was provided and coated with a dispersion which had been obtained by sufficiently dispersing a mixture of the following formulation in a ball mill, followed by drying at 100° C. for 5 hours to obtain a conductive adhesive layer with a dry thickness of 100μ.

| Formulation Of Conductive Adhesive Layer | |
|---|---|
| conductive carbon HS-500 (product of Asahi Carbon K.K.) | 4 g |
| epoxy resin #1001 (product of Shell Petrochemical Co.) | 20 g |
| butyl acetate | 100 ml |

The adhesive layer on the true support was superimposed on the intermediate conductive layer to be an uppermost layer of the superposed photosensitive layers formed on the temporary support, followed by pressing by means of heat rollers for adhesion and separating the 100μ thick polyester film temporary support to obtain a photosensitive plate with a smooth photosensitive layer surface (sample No. 5).

EXAMPLE 3

| Formulation Of Photosensitive Composition F | |
|---|---|
| cadmium sulfide fine crystals having an average particle size of 1μ | 20 g |
| exemplified prepolymer (2) | 12 g |
| exemplified prepolymer (7) | 3 g |
| water | 200 ml |
| ethyl alcohol | 100 ml |
| aqueous 30% ammonia | 5 ml |

A mixture of the above formulation was dispersed in a sand mill to prepare a photosensitive composition. The composition was coated onto an undercoat layer formed on a stainless steel plate by an electro-coating method. That is, a 100μ thick stainless steel plate was first immersed in a 5% solution of isocyanate-modified quaternary amine cation polymer, Elekond B-134D (Soken Chemical Co.) and then removed from the solution to form an undercoat layer on the stainless steel plate. Then, the photosensitive composition was introduced into a beaker. The steel plate was inserted into the beaker at one side thereof for use as a positive electrode. Another 100μ thick stainless steel plate to be a negative electrode was also placed in the beaker so that the two stainless steel plates were facing each other at a distance of 4 cm. Thereafter, an initial voltage of 30 V was applied between the electrodes to pass a current therebetween for 5 minutes while sufficiently agitating the composition by means of a magnetic stirrer, thereby forming a photosensitive layer by an electrophoretic method. The stainless steel plate removed from the beaker after completion of the voltage application was found to form thereon a yellow photosensitive layer with a thickness of several tens μ. When washed with water, no photosensitive layer was separated off or lost. Then, the photosensitive layer was dried and thermally treated at 150° C. for 1 hour to obtain a photosensitive plate (sample No. 6).

EXAMPLE 4

| Formulation Of Photosensitive Composition G | |
|---|---|
| cadmium sulfoselenide powder having an average particle size of 1μ | 10 g |
| exemplified prepolymer (2) | 5.4 g |
| exemplified prepolymer (13) | 1.0 g |
| exemplified prepolymer (10) (water-soluble melamine resin prepolymer having a solid content of 70%) | 2.0 g |
| water | 6 ml |
| isopropanol | 2 ml |
| n-butyl cellosolve | 2 ml |

A mixture of the above formulation was dispersed by the use of an ultrasonic dispersing device to prepare a photosensitive composition. Then, Elekond B-146 was applied onto a 200μ thick aluminum plate and dried to form an undercoat layer with a dry thickness of about 5μ. The photosensitive composition was further applied onto the undercoat layer so that the film thickness after drying was 20μ, dried and thermally treated at 130° C. for 30 minutes to form a lower photosensitive layer. Another photosensitive composition was prepared similarly to the photosensitive composition G using 0.10 g of FC-430. The thus prepared composition was applied onto the lower photosensitive layer so that a total thickness of the lower layer and upper layer after drying was 32μ, dried and thermally treated at 150° C. for 30 minutes to obtain a superposed layer photosensitive plate (sample No. 7).

COMPARATIVE EXAMPLE 1

| Photosensitive Composition H | |
|---|---|
| high sensitive cadmium sulfide fine crystals having an average particle size of 1μ | 10 g |
| pure alkyl resin Beccozol J-555 (product of Dainihon Ink K.K., solid content of 50%) | 8 g |
| butyl acetate | 7 ml |

A mixture of the above formulation was dispersed by the use of an ultrasonic dispersing device to prepare a photosensitive composition. The thus prepared composition was applied onto a 100μ thick stainless steel plate by a wire bar coating technique so that the film thickness after drying was 30μ, dried and thermally treated and subjected to a high temperature and high relative humidity test. That is, the durability tester was driven at 20 r.p.m. at a charging voltage of 6 KV and each sample was subjected to 5000 cycles of the charging and developing operations under conditions of 30° C. and 80% R.H. The initial potentials of the respective samples are shown in Table 1. For each sample, the residual percentage of the initial potential obtained after the 5000 cycles durability test to that obtained prior to the test is also shown in the Table.

Further, the surface roughness of each of the samples 1–4 and the comparative samples 8–10 was measured by means of a needle-type electric roughness tester (Thercomb 20 B, product of Toyo Seimitsu K.K.) with the test results of the Table.

From the following results, it will be understood that the samples of the present invention are far superior in residual potential, sensitivity, durability and surface roughness to the comparative examples.

TABLE 1

| | | electrophotographic properties | | | | | |
|---|---|---|---|---|---|---|---|
| | Sample No. | initial potential volt | residual potential volt | sensitivity lux/sec | initial potential (volt) obtained after 5000 cycles durability test | residual percentage of initial potential after the 5000 cycles test to that prior to the test % | surface roughness of photosensitive layer |
| samples of invention | 1 | 535 | 73 | 4.3 | 400 | 0.75 | 1.2 |
| | 2 | 415 | 64 | 5.2 | 302 | 0.73 | 0.5 |
| | 3 | 347 | 49 | 6.1 | 250 | 0.72 | 1.0 |
| | 4 | 323 | 51 | 1.5 | 236 | 0.73 | 1.5 |
| | 5 | 638 | 78 | 6.8 | 540 | 0.85 | — |
| | 6 | 333 | 40 | 4.9 | — | — | — |
| | 7 | 652 | 76 | 6.2 | 524 | 0.80 | — |
| Comparative samples | 8 | 618 | 115 | 8.0 | 302 | 0.49 | 3.0 |
| | 9 | 529 | 108 | 9.8 | 297 | 0.56 | 2.8 |
| | 10 | 457 | 95 | 8.8 | 250 | 0.55 | 3.2 |
| | 11 | 740 | 128 | 10.1 | 470 | 0.64 | — |

What is claimed is:

1. A photosensitive article comprising:

(1) a conductive substrate; and, (2) an uppermost photosensitive layer which is a heat-dried coating of a photosensitive composition comprising an aqueous solution of a water-soluble prepolymer capable of forming a network structure by cross-linking, and a photoconductive compound selected from the group consisting of cadmium sulfide, cadmium selenide, cadmium sulfoselenide, zinc sulfide and zinc selenide.

2. The article of claim 1 wheren said water-soluble prepolymer is at least one condensation-type prepolymer selected from the group consisting of an alkyd resin prepolymer, a phenolic resin prepolymer, an amino resin prepolymer, an epoxy resin prepolymer, an urethane resin prepolymer and a cellulose derivative.

3. The article of claim 1 wherein said water-soluble prepolymer is at least one polymerization-type prepolymer selected from the group consisting of a polyacrylic acid prepolymer, a derivative of a polyacrylic acid prepolymer, a polyacrylamide prepolymer, a polyvinylprrolidone prepolymer, a polyvinylether prepolymer, a polyvinylalcohol prepolymer and a copolymer thereof.

4. The article of claim 1 wherein said water-soluble prepolymer is in the form of ammonium salt.

5. The article of claim 1 wherein said water-soluble prepolymer is contained in an amount of from 10 to 100 parts by weight per 100 parts by weight of said photoconductive compound.

6. The article of claim 1 wherein said water is contained in an amount of from 20 to 300 parts by weight per 100 parts by weight of said photoconductive compound.

7. The article of claim 1 wherein said photosensitive composition further comprises a hardener selected from the group consisting of an aldehyde, an urea resin prepolymer, a melamine resin prepolymer, a phenolic resin prepolymer an epoxy, ester resin prepolymer and a polybasic acid, in an amount of from 0 to 100 parts by weight per 100 parts by weight of said photoconductive compound.

8. The article of claim 1 wherein said photosensitive composition further comprises a polymerization accelerator selected from the group consisting of cobalt naphthenate, calcium naphthenate and lead naphthenate in an amount of from 0 to 10 parts by weight per 100 parts by weight of said photoconductive compound.

9. The article of claim 1 wherein said photosensitive composition further comprises an amphipathic solvent selected from the group consisting of methyl alcohol, ethyl alcohol, isopropyl alcohol, n-propyl alcohol, secondary or tertiary butyl alcohol, methyl cellosolve, butyl cellosolve, ethoxybutyl alcohol and ether in an amount of from 0 to 300 parts by weight per 100 parts by weight of said photoconductive compound.

10. The article of claim 1 wherein said photosensitive composition further comprises a neutralizing agent selected from the group consisting of ammonia, triethylamine, mono-, di-, triethanol amine, dimethylamine ethanol and diethylaminoethanol.

11. The article of claim 1 wherein said photosensitive composition further comprises a fluorine-containing surface active agent.

12. A process for producing an electrophotographic element, said process comprising:

(1) coating a conductive substrate with the aqueous solution defined in claim 1; and, (2) heating the coated substrate to dry the coating, thereby producing the electrophotographic article.

13. The process of claim 12 wherein said conductive substrate is a metal plate.

14. The process of claim 12 wherein said conductive substrate is a thin metal film and plastic laminate.

15. The process of claim 12 wherein said drying is at a temperature of 60° to 250° C. and is conducted over a period of time of fifteen minutes to three hours.

* * * * *